US007437108B2

(12) United States Patent
Kim

(10) Patent No.: US 7,437,108 B2
(45) Date of Patent: Oct. 14, 2008

(54) DEVELOPING ROLLER FOR ELECTROGRAPHIC APPARATUS INCLUDING A BASE RUBBER, A CONDUCTIVE POLYMER, A CONDUCTIVE CARBON BLACK AND A BINDER RESIN AND ELECTROGRAPHIC APPARATUS CONTAINING THE DEVELOPING ROLLER

(75) Inventor: Tae-hyun Kim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 19 days.

(21) Appl. No.: 11/063,568

(22) Filed: Feb. 24, 2005

(65) Prior Publication Data

US 2005/0220502 A1 Oct. 6, 2005

(30) Foreign Application Priority Data

Apr. 2, 2004 (KR) ..... 10-2004-0022885

(51) Int. Cl.
*G03G 15/08* (2006.01)

(52) U.S. Cl. ..... 399/286

(58) Field of Classification Search ..... 399/286
See application file for complete search history.

(56) References Cited

U.S. PATENT DOCUMENTS 5,270,768 A * 12/1993 Murata ..... 399/176
5,565,968 A 10/1996 Sawa et al.
6,163,669 A * 12/2000 Aoki et al. ..... 399/159
6,393,243 B1 5/2002 Satoh et al.
6,397,032 B1 * 5/2002 Sakaizawa et al. ..... 399/286
6,458,883 B1 10/2002 Takashima et al.
6,558,781 B1 * 5/2003 Fuei et al. ..... 428/212
6,640,080 B2 * 10/2003 Endo et al. ..... 399/349
2002/0031378 A1 * 3/2002 Arai et al. ..... 399/286
2003/0096917 A1 * 5/2003 Hattori et al. ..... 525/403

FOREIGN PATENT DOCUMENTS

JP 56167752 A * 12/1981
JP 61-103955 5/1986
JP 11-282248 10/1999

* cited by examiner

*Primary Examiner*—Quana M Grainger
(74) *Attorney, Agent, or Firm*—Roylance, Abrams, Berdo & Goodman, L.L.P.

(57) ABSTRACT

A developing roller for an electrographic imaging apparatus, which comprises a base rubber, a conductive carbon black, a conductive polymer for controlling hardness of the base rubber and dispersion of the carbon black, and a binder resin for inhibiting migration of the conductive polymer to a surface of the developing roller, and an electrographic apparatus comprising the same are provided. The developing roller has excellent hardness, processibility, stability to resistance and resistance to migration.

24 Claims, 2 Drawing Sheets a-a' SECTION

DEVELOPING ROLLER FOR ELECTROGRAPHIC APPARATUS INCLUDING A BASE RUBBER, A CONDUCTIVE POLYMER, A CONDUCTIVE CARBON BLACK AND A BINDER RESIN AND ELECTROGRAPHIC APPARATUS CONTAINING THE DEVELOPING ROLLER

CROSS-REFERENCE TO RELATED APPLICATIONS

This application claims the priority of Korean Patent Application No. 2004-22885, filed on Apr. 2, 2004, in the Korean Intellectual Property Office, the disclosure of which is incorporated herein in its entirety by reference.

BACKGROUND OF THE INVENTION

1. Field of the Invention

The present invention relates to a developing roller comprising a semiconductive rubber for use in an electrostatic recording apparatus, and to an electrostatic recording apparatus using the developing roller. More particularly, the present invention relates to a developing roller for use in an electrostatic recording apparatus comprising an electrographic imaging apparatus, where the developing roller comprises a conductive carbon black, a conductive polymer and a binder resin. The invention is also directed to an electrographic imaging apparatus including the developing roller.

2. Description of the Related Art

Conventionally, an electrographic imaging apparatus for an electrographic method comprises a photoreceptor on which a digital image signal is received by exposing a region to form an electrostatic latent image, and a developing roller that applies a developing agent (hereinafter is referred to a toner) to the electrostatic latent image. The photoreceptor and the developing roller are rotated while in engagement with each other. One side of the developing roller includes a means for feeding a toner onto the developing roller. A transferring roller on a lower side of the photoreceptor is rotated while in engagement with the photoreceptor. A toner applied onto an electrostatic latent image of the photoreceptor is transferred to the transferring roller and then onto a recording medium passing through the photoreceptor and the developing roller to form an image.

The developing roller plays an important role in transferring a toner to a latent image on a photoreceptor to form a visible image. The developing roller must be prepared such that it has specific properties, in order to apply a toner smoothly and in proper amounts on a photoreceptor.

For example, a developing roller must have a small variation in physico-chemical properties to prevent the additives, etc. contained in a toner from separating from the toner and penetrating into the developing roller during charging of the toner and when friction is applied to the toner. Alternatively, a developing roller must have a small variation in electrical properties according to environmental changes to maintain the proper volume resistance and the necessary dielectric constant, and particularly to form an excellent image uniformly for a long time. Further, the filming phenomenon must not occur on the surface of the developing roller even after friction is applied for a long time with a toner.

A developing roller used in such electrostatic recording apparatus, etc. can be categorized into an ion conductive developing roller and an electron conductive developing roller.

An ion conductive developing roller uses a base rubber consisting of rubbers having a low volume resistance, such as a conductive hydrine-based rubber, in order to decrease the resistance of the roller. The base rubber can include conductive additives, for example, conductive polymer materials such as an ethylchlorohydrine, or ion conductive materials such as Na, Zn, K, Cu, Co or Ni. However, the rubber having a low resistance, such as a hydrine-based rubber, etc., used in the ion conductive developing roller is so expensive that it can be a factor in increasing the cost for producing a developing roller. Furthermore, a conductive additive such as an ion conductive material, which needs to be used in order to obtain satisfactory conductivity, changes molecular structures of a developing roller into a state that readily absorbs moisture. Thus, large variations in a volume resistance of the developing roller can occur as a resulting environmental change.

On the other hand, an electron conductive developing roller uses a carbon black or a metal powder such as copper in order to impart conductivity to a common base rubber. Accordingly, although an expensive conductive rubber having a low resistance is not used and the resistance according to environment little varies, the hardness of a roller can be increased by adding large amounts of a conductive carbon black, the resistance can become non-uniform as a result of poor dispersion of the carbon black or metal powder, and the roller surface is stained with a carbon black.

Research concerning such electron conductive developing roller has steadily progressed. U.S. Pat. No. 5,565,968 discloses a developing roller comprising a polyurethane, a nitrile rubber, a chloroprene rubber or butyl rubber, and the like, as the base rubber, and a carbon black and a conductive polymer. U.S. Pat. No. 6,393,243 discloses a developing roller that has a multi-layer structure consisting of an elastic layer and a resin layer, and uses a conductive polymer such as a polyacetylene, and the like. On the other hand, U.S. Pat. No. 6,458,883 discloses a developing roller that uses a mixture of a crosslinking polymer such as a butadiene rubber, a styrene-butadiene rubber, and a non-crosslinking polymer such as a nitrilebutadiene rubber as a base rubber. The roller also comprises a conductivity imparting agent and an ion conductivity imparting agent such as $LiCF_3SO_3$, and the like.

However, the hardness, the stability to resistance, the resistance to migration, etc. of the developing roller are not satisfactory for an actual electrographic imaging apparatus. In particular, when the developing roller comprises a conductive polymer and a carbon black, after extended use the conductive polymer material or the carbon black can migrate to the surface of the developing roller, thereby contaminating the image. Thus, a developing roller that can form improved images uniformly for a long period is required.

SUMMARY OF THE INVENTION

The present invention provides a developing roller having improved hardness, stability to resistance, processibility, and resistance to migration, compared to the prior developing rollers. The invention is also directed to an electrographic imaging apparatus including the novel developing roller.

According to an aspect of the present invention, there is provided a developing roller for an electrographic imaging apparatus comprising a base rubber; a conductive carbon black; a conductive polymer for controlling hardness of the base rubber and dispersion of the carbon black in the base rubber; and a binder resin for inhibiting migration of the conductive polymer to the surface of the developing roller.

According to another aspect of the present invention, there is provided an electrographic imaging apparatus comprising a charging roller; a developing roller; a light scanning apparatus; a transferring roller; a photoreceptor that is charged by the charging roller to form an electrostatic latent image by the light scanning apparatus, and forms a visible image by toner fed from the developing roller; and a driving member to drive the constituent members, wherein the developing roller comprises a base rubber; a conductive carbon black; a conductive polymer for controlling hardness of the base rubber and dispersion of the carbon black in the base rubber; and a binder resin for inhibiting migration of the conductive polymer to the surface of the developing roller.

The developing roller of the present invention is inexpensive, exhibits low variation of resistance as well as having excellent hardness, stability to resistance, processibility, resistance to migration, and the like. Accordingly, the developing roller can be used in an electrostatic recording apparatus such as a printer, a facsimile, a copying machine, and the like, to form an excellent image uniformly for a long time.

BRIEF DESCRIPTION OF THE DRAWINGS

These and other features and advantages of the present invention will become more apparent by describing in detail exemplary embodiments thereof with reference to the attached drawings in which.

DETAILED DESCRIPTION OF THE INVENTION

Figure 1:
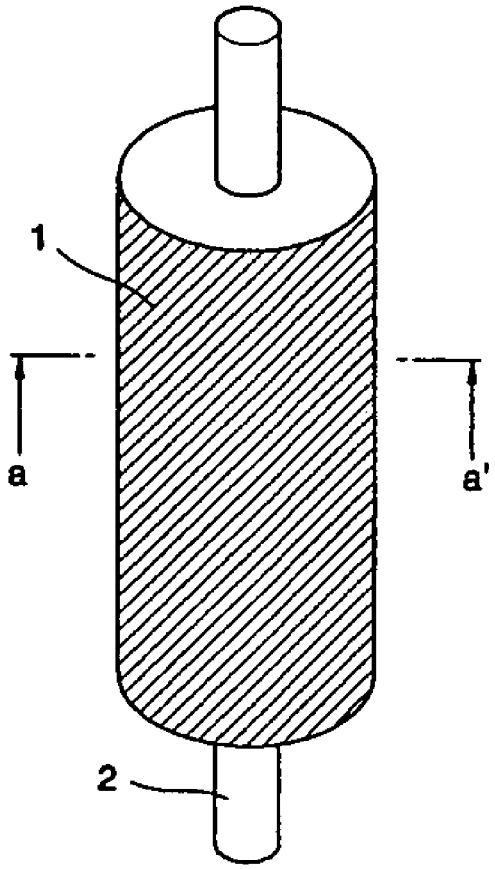
FIG. 1 is a perspective view illustrating an embodiment of the developing roller of the present invention.

The present invention will be described in more detail by describing the various embodiments.

The developing roller of the present invention uses a base rubber having a low dependency on resistance and the environment. Non-limiting examples of the base rubbers suitable for use in producing the developing roller of the present invention include an acrylonitrile butadiene rubber, a silicon rubber, an ethylene-propylene diene rubber, a styrene butadiene rubber, etc. Of these, the acrylonitrile butadiene rubber is a copolymer made by emulsion polymerization of an acrylonitrile and butadiene at low temperatures. The acrylonitrile butadiene rubber has excellent oil resistance and chemical resistance. As the acrylonitrile content of the acrylonitrile butadiene rubber increases, resinous properties of a rubber become strong, i.e., properties such as abrasion resistance, tensile strength, chemical resistance, etc. improve significantly while rebound resilience, permanent compression-strain, cryoprotectant property, elongation, etc. are reduced. When the amount of an acrylonitrile is more than 35% by mole based on the amount of an acrylonitrile butadiene rubber, the resistance becomes highly dependent on the environment. When the amount is less than 10% by mole based on the amount of an acrylonitrile butadiene rubber, the resistance of the resulting acrylonitrile butadiene rubber becomes high. Considering this, the acrylonitrile amount of the acrylonitrile butadiene rubber suitable for use in the present invention can be about 10% to about 35% by mole.

A conductive carbon black used in the developing roller of the present invention can be any carbon black that has a small average diameter of particles and a large surface area. The carbon black plays a role in imparting conductivity to the base rubber to control the resistance of a developing roller. Non-limiting examples of the carbon black include a conductive furnace black such as Ketjenblack EC, Ketjenblack 300J, Ketjenblack 600J, Vulcan XC, Vulcan CSX, Dencablack, and acetylene black. Amounts of the carbon black can be 1~50 parts by weight, preferably 1~20 parts by weight, and more preferably 1~10 parts by weight, based on 100 parts by weight of the base rubber. The amount of the carbon black used is determined by the conductivity of carbon black and migration of the carbon black to the surface of a developing roller.

The developing roller of the present invention comprises a conductive polymer. The carbon black used in providing conductivity to the base rubber as described above contributes mainly to an increase in hardness of the developing roller. As hardness increases, the toner stress increases, and it becomes difficult to ensure a nip between a photoreceptor and a developing roller. Further, an increase in hardness hinders the processibility of a developing roller, thereby causing scorching, and the like, on extrusion of the developing roller. Such problems caused by addition of carbon black can be solved by using a conductive polymer. The developing roller of the present invention comprises a conductive polymer such that its hardness is lowered, and the pattern viscosity of a rubber is reduced, and so carbon black can be uniformly dispersed in the base rubber. Thus, the developing roller can have a uniform and stable resistance on working.

Non-limiting examples of the conductive polymers include a polyanilline-based polymer, a polyanilline sulfone-based polymer, a polypyrrole, a polyacetylene and mixtures thereof. Amounts of the conductive polymers can be 1~30 parts by weight, preferably 1~20 parts by weight, and more preferably 1~10 parts by weight, based on 100 parts by weight of the base rubber.

The developing roller of the present invention comprises a binder resin. The conductive polymer used for improving hardness, processibility, and stability to resistance, has a tendency to migrate to the surface of the developing roller when the developing roller is left alone for a long time. Therefore, the binder resin of the present invention plays a role in inhibiting migration of such conductive polymers to the surface of the developing roller. This reduces or prevents the contamination of images otherwise caused by the migration of the conductive polymer to the surface of the developing roller such that superior images can be formed even after working for a long period.

Non-limiting examples of binder resins of the present invention include acrylic resins, polyvinyl alcohols, polyacrylamides, polyvinyl chlorides, urethane resins, acetic vinyl resins, butadiene resins, epoxy resins, alkyd resins, melamine resins, chlorophrene resins, and mixtures thereof. Amounts of the binder resins can be 1~50 parts by weight, preferably 1~40 parts by weight, and more preferably 1~15 parts by weight, based on 100 parts by weight of the base rubber in order to enhance resistance to migration of the conductive polymer.

The developing roller of the present invention further comprises at least one material selected from the group consisting of a filler, a crosslinking agent, a vulcanizing agent, a vulcanization accelerator, a softener, a dispersion agent and an anti-aging agent.

The developing roller of the present invention further comprises a filler. The filler plays a role in enhancing dimensional stability, abrasion resistance and grindability on continuous extrusion or injection of the developing roller, or press processing. Non-limiting examples of the fillers include various solid particulates such as calcium carbonate, magnesium carbonate, kaolin, clay, talc, calcium sulfate, barium sulfate, titanium dioxide, zinc oxide, zinc hydroxide, zinc sulfate, zinc carbonate, aluminum silicate, silicic acid, sodium silicate, diatomite, calcium silicate, magnesium silicate, synthetic silica, colloidal silica, alumina, colloidal alumina, aluminum hydroxide, magnesium hydroxide, and analogs and derivatives thereof. The filler can be used in mixtures of two or more fillers of these examples. Calcium carbonate can be included in the developing roller.

When the average particle diameter of the calcium carbonate as a filler is less than 0.01 μm, the workability can decrease. When the average particle diameter is more than 50 μm, abrasion resistance can be decreased. In view of this result, the average particle diameter of the calcium carbonate used as a filler can be 0.01 to 50 μm. Of the calcium carbonates, an activated calcium carbonate having a surface treated with an organic component can be used to improve dispersability with the base rubber. An organic component used as the calcium carbonate surface-treating agent can be a fatty acid, a resin acid, a surfactant, and the like. The amount of calcium carbonate can be 5~120 parts by weight, and preferably 10~100 parts by weight, based on 100 parts by weight of the base rubber. When the amount of the calcium carbonate is less than 5 parts by weight, the effect on abrasion resistance is low. When the amount of the calcium carbonate is more than 120 parts by weight, the workability can decrease.

The developing roller of the present invention further comprises a crosslinking agent. The crosslinking agent plays a role in crosslinking the base rubber to enhance the rubber properties of the developing roller. Specific examples of crosslinking agents suitable for the present invention include, but are not limited to, organic peroxides such as di-(2,4-dichlorobenzoyl)peroxide, dibenzoyl peroxide, tert-butylperoxybenzoate, 1,1-di-(tert-butylperoxy)-3,3,5-trimethylcyclohexane, dicumyl peroxide, di-(2-tert-butylperoxyisopropyl)-benzene, tert-butylcumyl peroxide, 2,5-dimethyl-2,5-di-(tert-butylperoxy)-hexane or di-tert-butylperoxide, and analogs and derivatives thereof. Of these, a dicumyl peroxide is preferred.

The developing roller of the present invention further comprises a vulcanizing agent. The vulcanizing agent is a crossing agent, which crosslinks rubber components. In one embodiment, the crosslinking agent is sulfur. In an alternative embodiment, the crosslinking agent comprises sulfur-containing material. Specific examples of the vulcanizing agents include, but are not limited to, sulfur; a sulfur donor; mercaptan triazines such as 2,4,6-trimercapto-1,3,5-triazine or 1-methoxy-3,5-dimercaptotriazine; or thioureas such as 1,3-diethyl thiourea, 1,3-dibutyl thiourea or trimethyl thiourea.

The developing roller of the present invention can further comprise a vulcanization accelerator. A vulcanization accelerator plays a role in increasing vulcanizing speed on vulcanizing and the rubber properties. A vulcanization accelerator can be categorized into thiazoles, thiurams, thiocarbamates, mixed accelerators, sulfenamides, and its specific examples include, but not limited to, zinc oxide, diphenyl guanidine, ditolyl guanidine, 2-mercapto benzothiazole, dibenzothiazyldisulfide, N-ethyl-2-benzothiazylsulfenamide, N-t-butyl-2-benzothiazylsulfenamide, tetramethyl thiuramdisulfide, tetraethyl thiuramsulfide, aniline, butylamine and 2-mercaptoimidazoline, and analogs and derivatives thereof. The vulcanization accelerator can be included in 0.1~10 parts by weight based on 100 parts by weight of the base rubber. The amount of the vulcanization accelerator is based on the desired vulcanization time.

The developing roller of the present invention can further comprise a softener. The softener plays a role in softening rubber, on preparing the developing roller, and to facilitate processing. The softener can be categorized as a plant-based softener such as castor oil, pine tar, tall oil, and the like, and a mineral-based softener such as a process oil, and the like.

The developing roller of the present invention can further comprise a dispersion agent. The examples of the dispersion agent include, but not limited to, oils and fats such as triglyceride, stearic acid, oleic acid, glycerine or a hardened(hydrogenated) fatty acid. Of these, stearic acid is generally preferred.

The developing roller of the present invention can further comprise an anti-aging agent. The anti-aging agent plays a role in preventing oxidation by oxygen, which is a major factor of aging. The anti-aging agent must have high solubility to the rubber, must have low volatility, and must not inhibit vulcanization. Specific examples of the anti-aging agents include, but not limited to, 2,2'-methylenebis-(4-methyl-6-tert-butylphenol) (MB-MTB), 2,6-di-tert-butyl4-methylphenol, 2,2'-methylenebis-(4-ethyl-6-tert-butylphenol), 4,4'-butylidene bis(3-methyl-6-tert- butylphenol), 4,4'-thiobis(6-tert-butyl-3-methylphenol), tri(nonylate phenyl) phosphite, N-phenyl-N'-isopropyl-p-phenyl-ethylenediamine (IPPD), N-(1,3-dimethyl-butyl)-N'-phenyl-p-phenylenediamine, 2,2,4-trimethyl-1,2-dihydroquinoline polymer (TMDQ) or 6-ethoxy-2,2,4-trimethyl-1,2-dihydroquinone (ETMDQ), and analogs and derivatives thereof. Of these, 2,2,4-trimethyl-1,2-dihydroquinoline polymer is generally preferred. Amounts of anti-aging agents can be included in 0.1~10 parts by weight based on 100 parts by weight of the base rubber. The actual amount used is based on the desired antioxidation effect and contamination.

Figure 1A:
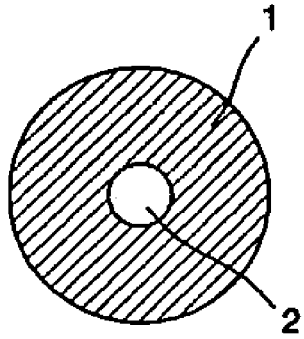
FIG. 1A is a cross sectional view taken along line a-a' of the developing roller of FIG. 1.

An embodiment of the developing roller of the present invention is described with reference to FIG. 1. FIG. 1 illustrates an embodiment of the developing roller of the present invention and FIG. 1A illustrates a cross sectional view taken along line a-a' of FIG. 1. Referring to FIG. 1, the developing roller of the present invention consists of a rubber layer 1 and a shaft 2 consisting of metals such as aluminum, copper, or other suitable metal. The rubber layer 1 comprises a base rubber, a conductive carbon black, a conductive polymer for controlling the hardness of the base rubber and dispersion of the carbon black, and a binder resin, as described above.

The developing roller of the present invention can be prepared by a simple process employing a mechanical mixing apparatus. An embodiment of the method for preparing a developing roller is described below. First, the base rubber is premixed by using a mechanical mixing apparatus. The mechanical mixing apparatus can be a kneader or an extruder, and comprise a Banbury mixer, Brabender mixer open roller, but is not limited to these. A carbon black, a conductive polymer, a binder resin, a filler, a crosslinking agent, a vulcanizing agent, a vulcanization accelerator, a softener, an anti-aging agent, etc. are added to the base rubber present in the mechanical mixing apparatus, and mixed to disperse uniformly. After aging the resulting mixture for some period, the mixture is extruded at a low temperature employing a single-screw extruder, and vulcanized to obtain vulcanized rubber tube. A hot-melt adhesive is applied to the circumference of a shaft previously prepared for supporting the developing roller, and then the shaft is inserted to the vulcanized rubber tube, and adhered to the shaft by the application of heat. The surface of the vulcanized rubber tube is then ground to the desired shape and dimension. Thus, a conductive developing roller having desired dimension can be prepared.

Figure 2:
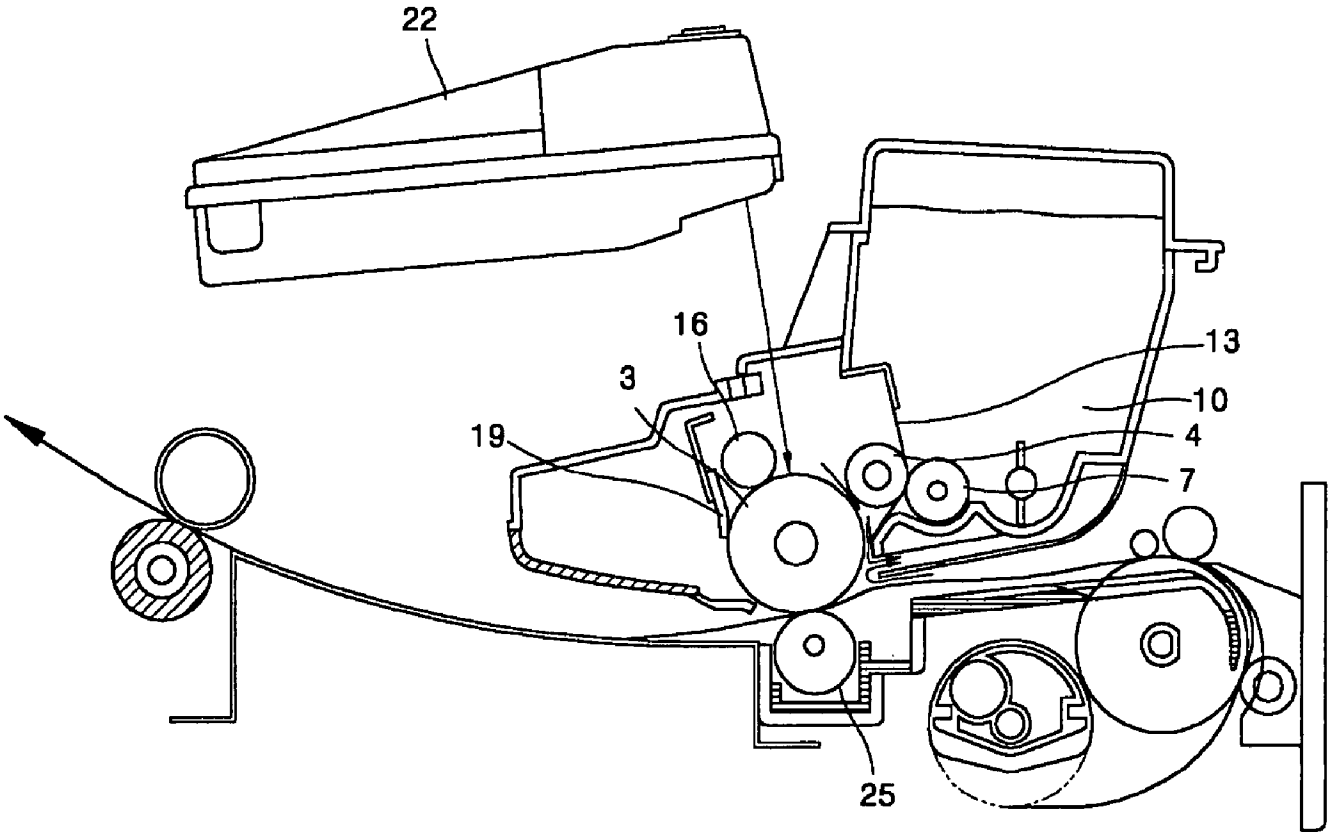
FIG. 2 illustrates a portion of an electrographic imaging apparatus provided with an embodiment of the developing roller of the present invention.

The developing roller of the present invention can be used in an electrographic apparatus such as electrophotographic imaging apparatus. An electrographic imaging apparatus, including the developing roller of the present invention, includes a conventional electrophotographic imaging apparatus such as a laser printer, a facsimile, a copying machine, and the like. Specific examples thereof include a laser beam or LED print head type printer, a facsimile, a copying machine and multifunction machine. FIG. 2 illustrates a part or section of an electrographic imaging apparatus provided with an embodiment of the developing roller of the present invention. The ordinary working mechanism of the electrographic imaging apparatus is as follows. A photoreceptor 3 having properties of photoconductive material and the surface of the photoreceptor 3 is charged with specific electrical potential by the charging roller 16. The charging roller 16 charges the photoreceptor 3 by employing a corona charging or roller charging apparatus. A latent image is formed on the surface of the photoreceptor 3 on exposing to light by using light scanning apparatus 22, and then a toner 10 is attached to the latent image. The toner 10 is attached to the photoreceptor 3, which the latent image is formed, by a developing roller 4 as a toner carrier. Amounts of the toner attached to the developing roller 4 are controlled by a toner feeding roller 7 and a toner layer control apparatus 13. The photoreceptor 3 having the toner attached thereto, transfers the toner to a recording medium by a transferring roller 25 having polarity counter to that of the photoreceptor, thereby forming the image. A cleaning-blade 19 plays a role in removing the toner remaining on the photoreceptor after transfer. The recording medium is moved in the direction of the arrow shown in FIG. 2.

The present invention will be described in greater detail with reference to the following examples. The following examples are for illustrative purposes and are not intended to limit the scope of the invention.

EXAMPLES

Examples 1 and 2

Preparation of a Developing Roller from a Conductive Polymer and a Binder Resin An acrylonitrile butadiene rubber (KNB25LM, manufactured by Korea Kumho Petrochemical Co., Ltd.), having an acrylonitrile content of 25% by mole, was premixed in an open roller apparatus pre-heated to 60° C. A Conductive Furnace Black (Ketjenblack 300J, manufactured by Japan Lion Company), a poly aniline sulfone based polymer (manufactured by Sigma-Aldrich Ltd.), an acrylic resin, a zinc oxide, a dicumylperoxide, a 2-mercaptoimidazoline, a stearic acid and a 2,2,4-trimethyl-1,2-dihydroquinoline (TMDQ) were added to the premixture, and then the mixing apparatus was operated at a temperature of 60° C. and a pressure of 1 atm to disperse the materials in the acrylonitrile butadiene rubber. The resulting dispersion was aged at ambient temperature for 8 hours, and then was extruded with a single-screw extruder, and the resulting extrudate was vulcanized in a vulcanizing chamber at a temperature of 150° C. and a pressure of 3 atm to form a three-dimensional network structure. The outer diameter and surface roughness of the resulting rubber tube was adjusted to form a developing roller. The coefficient of friction of the surface of the developing roller was decreased by irradiating with UV light to prepare samples 1 and 2. Weight ratios (parts by weight) used in preparing samples 1 and 2 are the same as described in Table 1 below:

TABLE 1

| | Sample 1 (Example 1) | Sample 2 (Example 2) |
|---|---|---|
| Acrylonitrile butadiene rubber (base rubber) | 100 | 100 |
| Conductive Furnace Black (conductive carbon black) | 7 | 7 |
| Polyanilline sulfone-based polymer (conductive polymer) | 2 | 5 |
| Acrylic resin (binder resin) | 3 | 10 |
| Zinc oxide (vulcanization accelerator aid) | 2 | 2 |
| Dicumylperoxide (crosslinking agent) | 2 | 2 |
| 2-mercaptoimidazoline (vulcanization accelerator) | 0.5 | 0.5 |
| Stearic acid (dispersion agent) | 1 | 1 |
| 2,2,4-trimethyl-1,2-dihydroquinoline polymer (anti-aging agent) | 0.5 | 0.5 |

(The amount of the base rubber is parts by weight; all other amounts are parts by weight based on 100 parts by weight of the base rubber.)

Comparative Examples 1 and 2

Samples 3 and 4 were prepared according to the same method used in Examples 1 and 2, except that amounts of Conductive Furnace Black and the polyanilline sulfone-based polymer and acrylic resin were adjusted as described in Table 2 below. Sample 3 did not contain a conductive polymer or a binder resin. Sample 4 did not contain a binder resin.

TABLE 2

| | Sample 3 (Comp. ex. 1) | Sample 4 (Comp. ex. 2) |
|---|---|---|
| Acrylonitrile butadiene rubber (base rubber) | 100 | 100 |
| Conductive Furnace Black (conductive carbon black) | 10 | 7 |
| Polyanilline sulfone-based polymer (conductive polymer) | 0 | 5 |
| Acrylic resin (binder resin) | 0 | 0 |
| Zinc oxide (vulcanization accelerator aid) | 2 | 2 |
| Dicumylperoxide (crosslinking agent) | 2 | 2 |
| 2-mercaptoimidazoline (vulcanization accelerator) | 0.5 | 0.5 |
| Stearic acid (dispersion agent) | 1 | 1 |
| 2,2,4-trimethyl-1,2-dihydroquinoline polymer (anti-aging agent) | 0.5 | 0.5 |

(The amount of the base rubber is parts by weight; all other amounts are parts by weight based on 100 parts of the base rubber.)

Evaluation Example 1

Evaluation for the Properties of the Developing Roller According to the Present Invention NN resistance, LL environmental resistance, HH environmental resistance, hardness, roughness and coefficient of friction for Samples 1~4 prepared according to the Preparation examples were evaluated, respectively, and the results are described in Table 3 below.

Resistance was measured by employing an ampere meter, a voltmeter and a jig. Specifically, a roller to be measured was mounted on a jig, a load of 1000 KG was loaded, a voltage of −500V was applied, and an electric current was measured to obtain a resistance value. LL environmental resistance was measured at a temperature of 10° C. and a humidity of 20%, NN environmental resistance was measured at a temperature of 23° C. and a humidity of 55% and HH environmental resistance was measured at a temperature of 32° C. and a humidity of 80%.

On the other hand, the hardness was measured by using Shore A type and the roughness was measured by obtaining centerline average roughness (Ra) in the circumferential direction with Mach equipment. The coefficient of friction was measured by suspending a weight of 70 g on OHP film, setting on the roller, and pulling on a speed of 70 mm/min.

TABLE 3

| | Sample 1 (Example 1) | Sample 2 (Example 2) | Sample 3 (Comp. Ex. 1) | Sample 4 (Comp. Ex. 2) |
|---|---|---|---|---|
| NN environmental resistance | $6.0 \times 10^{-5}$ | $3.0 \times 10^{-5}$ | $4.0 \times 10^{-5}$ | $4.0 \times 10^{-5}$ |
| LL environmental resistance | $8.0 \times 10^{-5}$ | $4.4 \times 10^{-5}$ | $6.0 \times 10^{-5}$ | $4.8 \times 10^{-5}$ |
| HH environmental resistance | $5.0 \times 10^{-5}$ | $1.0 \times 10^{-5}$ | $3.0 \times 10^{-5}$ | $2.1 \times 10^{-5}$ |
| Hardness (shore A) | 49 | 51 | 56 | 50 |
| Roughness (Ra) | 2.2 | 2.3 | 2.6 | 2.3 |
| Coefficient of friction | 0.23 | 0.21 | 0.29 | 0.22 |

From the Table 3, it can be seen that the hardness of Samples 1, 2 and 4 were improved. The Sample 3 which did not use poly aniline based polymer as the conductive polymer did not exhibit improved hardness.

Evaluation Example 2

Performance Evaluation of a Developing Roller Comprising a Conductive Polymer and a Binder Resin at an Electrographic Imaging Apparatus Samples 1, 3 and 4 were assembled to a developer, and the performance of each sample in an electrographic imaging apparatus was evaluated per 0, 500, 1,000, 1,500, 2,000, 2,500 and 3,000 pages. The evaluation items are as follows:

1) I/D: concentration of black measured by a concentration meter
2) 2 by 2: black band, white band, and concentration step
3) C/S: Compression set
4) Dot reproducibility: reproducibility of one dot line The results of performance evaluation for Samples 1, 3 and 4 are shown in Tables 4a, 4b and 4c, respectively.

TABLE 4a

The results of performance evaluation for Sample 1

| | Initial | 500 | 1,000 | 1,500 | 2,000 | 2,500 | 3,000 |
|---|---|---|---|---|---|---|---|
| I/D | ○ | ○ | ○ | ○ | ○ | ○ | Δ + |
| 2 by 2 | ○ | ○ | ○ | ○ | ○ | Δ + | Δ + |
| C/S | ○ | ○ | ○ | ○ | ○ | ○ | ○ |
| Dot reproducibility | ○ | ○ | ○ | ○ | ○ | ○ | Δ + |

TABLE 4b

The results of performance evaluation for Sample 3

| | Initial | 500 | 1,000 | 1,500 | 2,000 | 2,500 | 3,000 |
|---|---|---|---|---|---|---|---|
| I/D | ○ | ○ | ○ | ○ | ○ | Δ − | Δ − |
| 2 by 2 | ○ | ○ | Δ + | Δ + | Δ − | x | x |

TABLE 4b-continued

The results of performance evaluation for Sample 3

| | Initial | 500 | 1,000 | 1,500 | 2,000 | 2,500 | 3,000 |
|---|---|---|---|---|---|---|---|
| C/S | ○ | ○ | ○ | ○ | ○ | ○ | ○ |
| Dot reproducibility | ○ | ○ | ○ | ○ | Δ + | Δ + | Δ − |

TABLE 4c

The results of performance evaluation for Sample 4

| | Initial | 500 | 1,000 | 1,500 | 2,000 | 2,500 | 3,000 |
|---|---|---|---|---|---|---|---|
| I/D | ○ | ○ | ○ | ○ | ○ | Δ + | Δ − |
| 2 by 2 | ○ | ○ | ○ | ○ | Δ + | Δ + | Δ + |
| C/S | x | ○ | ○ | x | Δ − | ○ | ○ |
| Dot reproducibility | ○ | ○ | ○ | ○ | ○ | Δ + | Δ + |

○: excellent
Δ +: good
Δ −: acceptable
x: poor

From the Tables 4a, 4b and 4c, it can be seen that the performance of the developing roller of Sample 1, produced according to the present invention in an electrographic imaging apparatus is excellent compared to the developing rollers of Samples 3 and 4 even after working for a long period. Particularly, the hardness of Sample 1 was decreased compared to Samples 3 and 4, and black band, white band, concentration step etc. at 2 by 2 image are excellent compared to Samples 3 and 4. Further, Sample 1 exhibited a reduced toner stress due to low hardness and exhibited excellent toner reproducibility compared to Samples 3 and 4. On the other hand, the C/S of Sample 1 which used a binder resin is more enhanced compared to Sample 4 which included only a conductive polymer without a binder resin. From the results, improvements in resistance to migration for Sample 1 according to the present invention can be found.

The developing roller according to the present invention is inexpensive and has a low dependency on the environment, and can obtain effects of decrease in toner stress and increase in nip between a photoreceptor and a developing roller as a result of the developing roller containing a conductive polymer and a binder resin. Also, the pattern viscosity of a rubber consisting of the developing roller can become small, and so carbon black can be uniformly dispersed, and thus eliminating the non-uniformity of resistance. Further, as the developing roller according to the present invention uses a binder resin, the migration of the conductive polymer to the surface of the roller is prevented. Thus, the developing roller forms excellent images uniformly even after using for a long period.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A developing roller for an electrographic imaging apparatus comprising a mixture of a base rubber; a conductive carbon black; a conductive polymer in an amount of about 1-20 parts by weight based on the weight of the base rubber for controlling hardness of the base rubber and dispersion of the carbon black; and a binder resin in an amount of about 1 to 50 parts by weight based on 100 parts by weight of the base rubber for inhibiting migration of the conductive polymer and carbon black to a surface of the developing roller, wherein said carbon black, conductive polymer and binder resin are dispersed in said base rubber.

2. The developing roller for an electrographic imaging apparatus of claim 1, wherein the base rubber comprises an acrylonitrile butadiene rubber.

3. The developing roller for an electrographic imaging apparatus of claim 1, wherein the conductive carbon black comprises an acetylene black or a Conductive Furnace Black.

4. The developing roller for an electrographic imaging apparatus of claim 1, wherein the conductive carbon black is included in an amount of about 1~50 parts by weight based on 100 parts by weight of the base rubber.

5. The developing roller for an electrographic imaging apparatus of claim 1, wherein the conductive polymer is selected from the group consisting of polyanilline-based polymers, polyanilline sulfone-based polymers, polypyrroles, polyacetylenes, and mixtures thereof.

6. The developing roller for an electrographic imaging apparatus of claim 1, wherein the binder resin is selected from the group consisting of acrylic resins, polyvinyl alcohols, polyacrylamides, polyvinyl chlorides, urethane resins, acetic vinyl resins, butadiene resins, epoxy resins, alkyd resins, melamine resins, chlorophrene resins, and mixtures thereof.

7. The developing roller for an electrographic imaging apparatus of claim 1, wherein the developing roller further comprises at least one material selected from the group consisting of fillers, crosslinking agents, vulcanizing agents, vulcanization accelerators, softeners, dispersion agents and anti-aging agents.

8. The developing roller for an electrographic imaging apparatus of claim 7, wherein the crosslinking agent comprises an organic peroxide.

9. The developing roller for an electrographic imaging apparatus of claim 7, wherein the vulcanizing agent is selected from the group consisting of sulfur, a sulfur donor, mercaptan triazines and thioureas.

10. An electrographic imaging apparatus comprising a developing roller; and a driving member to drive the developing roller, wherein the developing roller comprises a mixture of a base rubber; a conductive carbon black; a conductive polymer in an amount of about 1-20 parts by weight based on the weight of the base rubber for controlling hardness of the base rubber and dispersion of the carbon black in the base rubber; and a binder resin in an amount of about 1 to 50 parts by weight based on 100 parts by weight of the base rubber for inhibiting migration of the conductive polymer and carbon black to a surface of the developing roller, wherein said carbon black, conductive polymer and binder resin are dispersed in the base rubber.

11. The electrographic imaging apparatus of claim 10, wherein the base rubber comprises an acrylonitrile butadiene rubber.

12. The electrographic imaging apparatus of claim 10, wherein the conductive polymer is selected from the group consisting of polyanilline-based polymers, polyanilline sulfone-based polymers, polypyrroles, polyacetylenes, and mixtures thereof.

13. The electrographic imaging apparatus of claim 10, wherein the binder resin is selected from the group consisting of acrylic resins, polyvinyl alcohols, polyacrylamides, polyvinyl chlorides, urethane resins, acetic vinyl resins, butadiene resins, epoxy resins, alkyd resins, melamine resins, chlorophrene resins, and mixtures thereof.

14. The developing roller of claim 1, wherein said conductive polymer is included in an amount of about 1-10 parts by weight based on 100 parts by weight of the base rubber.

15. The developing roller of claim 2, wherein said acrylonitrile butadiene base rubber has an acrylonitrile content of about 10% to 35% by mole based on the amount of the acrylonitrile butadiene rubber.

16. The developing roller of claim 1, wherein the binder resin is included in an amount of about 1-15 parts by weight based on 100 parts of the base rubber.

17. A developing roller for an electrographic imaging apparatus comprising a mixture of an acrylonitrile butadiene base rubber having an acrylonitrile content of about 10% to 35% by mole based on the amount of the acrylonitrile butadiene rubber; about 1-10 parts by weight of a conductive carbon black; about 1-10 parts by weight of a conductive polymer for controlling hardness of the base rubber and dispersion of the carbon black in the base rubber; and about 1-15 parts by weight of a binder resin for inhibiting migration of the conductive polymer and carbon black to a surface of the roller, wherein said parts by weight are based on 100 parts by weight of said base rubber, and wherein said carbon black, conductive polymer and binder resin are dispersed in said base rubber.

18. The developing roller for an electrographic imaging apparatus of claim 17, wherein the conductive carbon black comprises an acetylene black or a Conductive Furnace Black.

19. The developing roller for an electrographic imaging apparatus of claim 17, wherein the conductive polymer is selected from the group consisting of polyanilline-based polymers, polyanilline sulfone-based polymers, polypyrroles, polyacetylenes, and mixtures thereof.

20. The developing roller for an electrographic imaging apparatus of claim 17, wherein the binder resin is selected from the group consisting of acrylic resins, polyvinyl alcohols, polyacrylamides, polyvinyl chlorides, urethane resins, acetic vinyl resins, butadiene resins, epoxy resins, alkyd resins, melamine resins, chlorophrene resins, and mixtures thereof.

21. The developing roller for an electrographic imaging apparatus of claim 17, wherein the developing roller further comprises at least one material selected from the group consisting of fillers, crosslinking agents, vulcanizing agents, vulcanization accelerators, softeners, dispersion agents and anti-aging agents.

22. The developing roller for an electrographic imaging apparatus of claim 21, wherein the crosslinking agent comprises an organic peroxide.

23. The developing roller for an electrographic imaging apparatus of claim 21, wherein the vulcanizing agent is selected from the group consisting of sulfur, a sulfur donor, mercaptan triazines and thioureas.

24. A cartridge comprising a developing roller; wherein the developing roller comprises a mixture of a base rubber; a conductive carbon black; a conductive polymer in an amount of about 1-20 parts by weight based on the weight of the base rubber for controlling hardness of the base rubber and dispersion of the carbon black in the base rubber; and a binder resin in an amount of about 1 to 50 parts by weight based on 100 parts by weight of the base rubber for inhibiting migration of the conductive polymer to a surface of the developing roller, wherein said carbon black, conductive polymer and binder resin are dispersed in the base rubber.

* * * * *